United States Patent [19]

Ostrow et al.

[11] 4,000,047

[45] Dec. 28, 1976

[54] ELECTRODEPOSITION OF TIN, LEAD AND TIN-LEAD ALLOYS

[75] Inventors: Barnet D. Ostrow; Fred I. Nobel, both of Roslyn; Lazaro Yoen, Brooklyn, all of N.Y.

[73] Assignee: Lea-Ronal, Inc., Freeport, N.Y.

[22] Filed: Dec. 20, 1974

[21] Appl. No.: 535,146

Related U.S. Application Data

[63] Continuation-in-part of Ser. No. 307,354, Nov. 17, 1972, abandoned.

[52] U.S. Cl. ..... 204/43 S; 204/53; 204/54 R

[51] Int. Cl.[2] ..... C25D 3/32; C25D 3/36; C25D 3/60

[58] Field of Search ..... 204/43 S, 53, 54 R, 204/114, 120, 123

[56] References Cited

UNITED STATES PATENTS

| | | | |
|---|---|---|---|
| 2,457,152 | 12/1948 | Hoffman | 204/54 R |
| 2,552,920 | 5/1951 | Allen | 204/54 R |
| 3,661,730 | 5/1972 | Nishihara | 204/43 S |
| 3,730,853 | 5/1973 | Sedlacek et al. | 204/43 S |

*Primary Examiner*—G. L. Kaplan
*Attorney, Agent, or Firm*—Pennie & Edmonds

[57] ABSTRACT

A bath for the electrodeposition of bright tin-lead alloys which comprises an aqueous acidic bath containing at least one soluble tin compound and one soluble lead compound to which there has been added:

a. a lower alkylene oxide condensation product, and b. an effective amount of at least one pyridine or quinoline compound having the structure wherein the substituents $R_1$, $R_2$, $R_3$, $R_4$ and $R_5$ each is a hydrogen or halogen atom, a lower alkyl radical containing a hydroxyl group, an alkenyl radical, the radical $(C_nH_{2n})$-$CO_2H$ in which $n$ has a value from 0 to 6 or a carbamide radical or $R_4$ and $R_5$ combined form a divalent radical to provide a compound having the structure in which $R_6$ is nothing or a hydroxyl radical; Z is nothing, $0^-$ or a quaternary ammonium forming hydrocarbon radical provided that when Z is nothing, at least one of the substituents $R_1$, $R_2$, $R_3$, $R_4$ and $R_5$ is a halogen atom, a lower alkyl radical containing a hydroxyl group, an alkenyl radical, the radical $(C_nH_{2n})$-$CO_2H$ in which $n$ has a value from 0 to 6 or a carbamide radical or $R_6$ is a hydroxy radical; and X is nothing or when Z is a quaternary ammonium forming hydrocarbon radical X is an anion.

The invention also includes the addition of an aromatic aldehyde in combination with pyridine or quinoline compounds and the alkylene oxide condensation product which results in the production of even brighter to brilliant deposits over a wide current density range.

16 Claims, No Drawings

ELECTRODEPOSITION OF TIN, LEAD AND TIN-LEAD ALLOYS

RELATED APPLICATION

This is a continuation in part of application Serial No. 307,354, filed Nov. 17, 1972, entitled ELECTRODEPOSITION OF TIN-LEAD ALLOYS, now abandoned.

BACKGROUND OF THE INVENTION

I. Field of the Invention

This invention generally relates to the field of electrodeposition, and, specifically, to the electrodeposition of tin-lead alloys from aqueous acid baths.

II. Description of the Prior Art

Tin-lead alloys have been successfully deposited from acid fluoborate ($HBF_4$) baths. However, in order to reduce the tendency of the fluoborate baths to form non-adherent, treed and/or dark deposits, certain additives must be incorporated into these baths. Additives which have long been known and used for this purpose include such materials as glue, gelatin, hydroquinone, peptone and so forth.

It is of particular interest to electrodeposit tin-lead alloys of 60% tin and 40% lead which are bright. It is also of interest to deposit tin-lead alloys having low concentration of lead, as for example, from about 1 to 2% lead.

N. Dohi in "Metal Finishing" Vol 64 p. 62–3 (October 1966) discloses a bright tin-lead $HBF_4$ bath employing an ethylene oxide condensation product as a wetting agent, formaldehyde (20 ml/liter) and an acetaldehyde/ortho-toluidine reaction product (Schiff base).

French Pat. No. 2,096,936 discloses a bright tin-lead (60–40) acid fluoborate bath containing as an organic additive a substituted phenol such as 2,4,6-trimethyl phenol, an aldehyde such as formaldehyde in the amount of from 30 to 50 gm of a 38% solution as a reducing agent and an ethoxylated high molecular weight amine or alkylamine as a wetting agent.

U.S. Pat. No. 3,661,730 discloses a bright tin-lead bath employing formaldehyde (10–30 ml/liter), an ethylene oxide condensation product as a wetting agent and a Schiff base (a reaction product of an aldehyde and an amine) or orthotoluidine.

U.S. Pat. No. 2,446,716 discloses a bath employing nicotine and a wetting agent such as Duponol 80 (Dupont's sodium salt of technical octyl alcohol sulfate). The combination of nicotine, alkylene oxide condensation products and an aromatic aldehyde, however, do not produce acceptably bright tin-lead deposits.

None of the aforesaid baths have attained sufficient commercial acceptance due to several major disadvantages attributable to them.

The concentrations of formaldehyde indicated are comparatively high and result in highly objectionable and irritating odors.

The Schiff base reaction products of the organoamines and aromatic aldehydes are unstable. Upon standing idle or after a short period of electrolysis, dull, low-current density areas will result. Excess use of corrective brighteners must be made in order to overcome the low current density problem. This leads to difficulty in the adjustment of the bath and also makes the bath expensive to operate.

The aforedescribed baths with continued operation or with periods of idleness have only a narrow bright plating range. If the low current density areas are satisfactory, the high current density areas are dull, the reverse also being true.

SUMMARY OF THE INVENTION

This invention relates to a bath for the electrodeposition of bright tin-lead alloys which comprises an aqueous fluoborate acid bath containing at least one soluble tin and lead compound to which has been added:

a. a lower alkylene oxide containing compound or adduct, and b. at least one compound having the structure

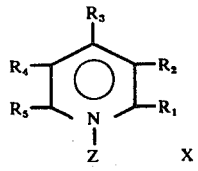

wherein the substituents $R_1$, $R_2$, $R_3$, $R_4$ and $R_5$ each is a hydrogen or halogen atom, a lower alkyl radical containing a hydroxyl group, an alkenyl radical, the radical ($C_nH_{2n}$—$CO_2H$ in which $n$ has a value from 0 to 6 or a carbamide radical or $R_4$ and $R_5$ combined form a divalent radical to provide a compound having the structure.

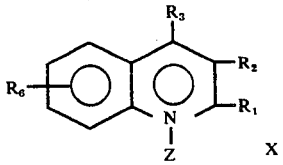

in which $R_6$ is nothing or a hydroxyl radical; Z is nothing, $0^-$ or a quaternary ammonium forming hydrocarbon radical provided that when Z is nothing, at least one of the substituents $R_1$, $R_2$, $R_3$, $R_4$ and $R_5$ is a halogen atom, a lower alkyl radical containing a hydroxyl group, an alkenyl radical, the radical ($C_nH_{2n}$—$CO_2H$ in which $n$ has a value from 0 to 6 or a carbamide radical or $R_6$ is a hydroxyl radical; and X is nothing or when Z is a quaternary ammonium forming hydrocarbon radical X is an anion.

When $R_4$ and $R_5$ in the above structure are not combined the structure defines substituted pyridine compounds and/or the N-oxides or quaternary salts of pyridine compounds. When $R_4$ and $R_5$ are joined together, the resulting structure defines substituted quinoline compounds and/or the N-oxides or quaternary salts of quinoline compounds.

The electrodeposition method and baths of this invention thus produce bright tin-lead deposits over a wide range of current densities. Known addition agents which modify the tin-lead deposit to provide semi-lustrous or fully bright deposits can be incorporated into the baths of this invention if desired. These addition agents can be used with, or preferably without, formaldehyde. Formaldehyde may be added but generally with poorer results.

DESCRIPTION OF THE PREFERRED EMBODIMENTS

The alpha (2) pyridine and quinoline compounds and their reaction products have been found to be especially advantageous for use in the method and baths of this invention. The aminopyridines, however, have been found to have little or no effect.

The halogenated pyridines or halogen substituted pyridines produce an operable stable bath but experiments to date indicate that these halogenated pyridines do not have the same brightening power over a wide current density range that is obtained from the non-halogenated pyridines.

The pyridine carboxylic acids possess the desirable property of being stable in the highly acidic fluoborate baths and do not decompose when the bath is idle. When used with high molecular weight alkylene oxide condensates such as polyethylene glycol 500 or polyalkylene fatty acids, amides, amines, alcohols or phosphates and so forth, the pyridines and quinolines herein produce non-treed smooth uniform and semi-lustrous deposits.

Other pyridine compounds which can advantageously be employed are the pyridine $N^-$ oxides and their reaction products. When in addition to the aforesaid pyridine and quinoline compounds and polyalkyleneoxide condensation products, aromatic aldehydes are included in the baths, fully bright tin-lead deposits over a wide current density range are produced and the baths remain stable over prolonged periods of idleness and operation.

Other pyridine compounds which can be advantageously employed are the quaternized compounds. The pyridine compounds can be quaternized by standard procedures known in the art using standard compounds such as aryl and alkyl halides, sulfates and the like.

Table I below sets forth some classes and specific examples of pyridine and quinoline compounds which have been found useful in this invention.

TABLE I

Pyridine carboxylic acids
Pyridine halogen carboxylic acids
Pyridine carbamides
Pyridine N-oxides
Ethanol pyridine N-oxides
Pyridine carboxylic acids quaternized with dimethyl sulfate
Pyridine carboxylic acids quaternized with p-methyltoluenesulfate
Pyridine carboxylic acids quaternized with benzyl chloride
Pyridine carboxylic acids reacted with chloromethylanisaldehyde
Pyridine carboxylic acids reacted with chloromethylparahydroxybenzaldehyde
Pyridine N-oxide carboxylic acids
Quinoline carboxylic acid
hydroxyquinoline
Quinoline N-oxide
vinylpyridines
vinylpyridine N-oxides
chloropyridine N-oxides Examples of specific and more preferred pyridines coming within the classes of pyridine compounds of TABLE I are set forth in TABLE II hereinbelow:

TABLE II

| STRUCTURE | NAME |
|---|---|
| 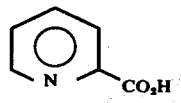 | 2-carboxypyridine ($\alpha$-picolinic acid) |
| 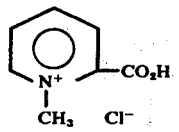 | 2-carboxy-N-methyl-pyridinium chloride |
| 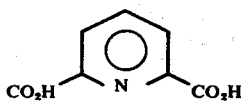 | 2,6 dicarboxypyridine |
| 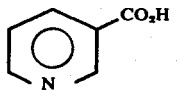 | nicotinic acid ($\beta$-picolinic acid) |
| 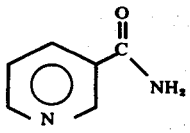 | nicotinamide |
| 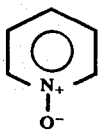 | pyridine oxide |

TABLE II-continued
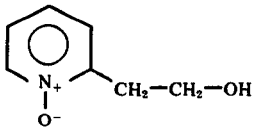
2-ethanolpyridine oxide
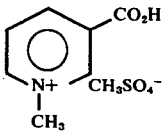
3-carboxy-N-methylpyridimium methylsulfate
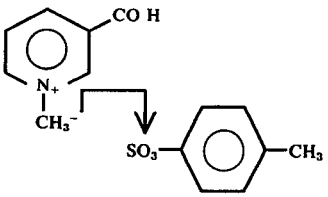
3-carboxy-N-methylpyridinum tosylate
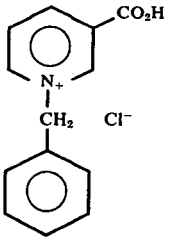
3-carboxy N-benzyl pyridinium chloride
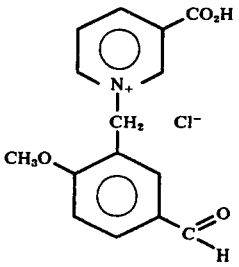
3-carboxy N-[3-formyl-6-methoxy] benzylpyridinium chloride
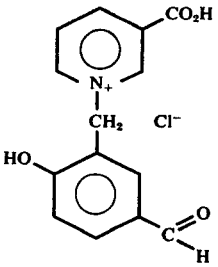
3-carboxy N-[3-formyl-6-hydroxy]-benzylpyridinium chloride
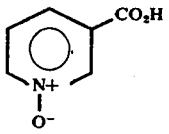
3-carboxypyridine N-oxide
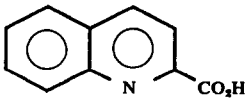
2-carboxyquinoline
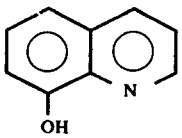
8-hydroxyquinoline TABLE II-continued

| | |
|---|---|
| 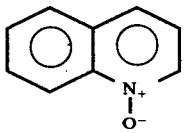 | quinoline N-oxide |
| 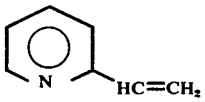 | 2-vinylpyridine |
| 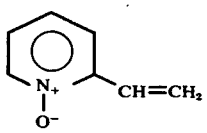 | 2-vinylpyridine N-oxide |
| 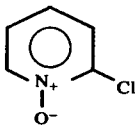 | 2-chloropyridine N-oxide |

Some examples of polyalkylene oxide (i.e., ethylene or propylene oxide) containing compounds or condensation products which can be advantageously employed are set forth in TABLE III below. The substituent R therein designates an alkyl or aryl radical containing 6 to 20 carbon atoms, the substituent R′ is $-CH_2)_y$ wherein $y$ is an integer from 1 to 6 and $n$ and $n'$ are each an integer from 2 to 6.

TABLE III polyethylene glycol 500
polypropylene glycol 750
nonylphenol condensed with 15 moles of ethylene oxide
$HO(C_2H_4)_a(C_3H_6O)_b(C_2H_4O)_cH$
where $a$, $b$ and $c$ are lower integers such as $a$=4, $b$=4 and $c$=2.
methoxy polyethylene glycol having a molecular weight of 2,000 or 5,000

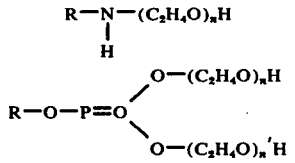

$R-S-(C_2H_4O)_nH$

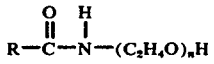

$R-N-R'-(C_2H_4O)_nH$

Nonylphenol condensed with about 10–14 moles of ethylene oxide has been found to be especially advantageous. When a polyglycol is selected and the compound does not function as a wetting or dispersing agent, it may be advantageous to add a dispersing agent for some of the ingredients in the bath such as the aromatic aldehydes, if used. In this case, such dispersing agents as sodium octyl sulfate or compounds of similar behavior which do not exert an adverse effect upon the solution can be employed.

The ethylene oxide compounds act as brighteners for the tin-lead alloy deposits. It is, of course, advantageous to employ an ethylene compound which not only functions as a brightener but also as a dispersing agent.

Table IV below includes some of the aromatic aldehydes which can be employed in the method and baths of this invention to further increase the brightness of the deposits:

TABLE IV o-methoxybenzaldehyde
3-ethoxybenzaldehyde
o-tolualdehyde (2-methylbenzaldehyde)
p-chlorobenzaldehyde
Cinnamaldehyde
o-chlorobenzaldehyde
Furfural
2-Methoxy-4-hydroxybenzaldehyde
o-allyl ether of 2-hydroxybenzaldehyde
o-propargyl ether of 2-hydroxybenzaldehyde
Thiophene-2-aldehyde
o-fluorobenzaldehyde
Dichlorobenzaldehyde
Difluorobenzaldehyde
o-phthalaldehyde o-methoxybenzaldehyde, o-chlorobenzaldehyde and the allylether of 2-hydroxybenzaldehyde have been found to be especially advantageous.

The quantities of tin and lead compounds, aromatic aldehyde, dispersing agent and pyridine or quinoline compound which can be used in the baths of this invention will vary according to the deposition effects desired and the current density employed. The pyridine or quinoline compounds are used in amounts to produce brighter deposits of the tin and lead compounds. The dispersing agents are used in amounts to cause the resultant brightening deposits to occur over wide current density ranges. Selection of optimum levels of the aforesaid ingredients for a particular plating operation can be readily determined by one skilled in the art using known and conventional techniques.

Although the use of the pyridine or quinoline compounds produce bright deposits over a wide current density range, they do not produce a bright acceptable tin-lead alloy deposit at very low current densities, such as below about 5 ASF. This invention also includes the use of thallium compound or salt to improve the brightness of the tin-lead alloy deposits at the very low current density range below about 5. ASF Various thallium compounds or salts can be used according to the invention so long as they are soluble in water or in the bath media, so that thallium ions are present in the bath during the electrodeposition of the tin-lead alloy. Some specific examples of thallium compounds which can be used according to the invention include thallium acetate, thallium halides, such as thallium chloride and thallium oxide.

The amount of thallium compounds or salts which can be used to improve the brightness of the coatings in the very low current density range will depend not only upon the brightness desired, but the other ingredients used in the bath. Generally about 0.2 g/l of the thallium compound or salt produces very acceptable brightness in this very low current density range when used in conjunction with the pyridine or quinoline compounds disclosed herein. The minimum amount of the thallium compound to obtain acceptable brightness is about 0.1 g/l. More than 0.2 g/l of the thallium compound can be used; however, it does not appear that any additional advantages are gained by using these large amounts. Experiments to date show that when these thallium compounds are used in conjunction with the pyridine or quinoline compounds that acceptable bright deposits can be obtained at current density ranges down to about 0.5 ASF.

Examples 1 to 10 were carried out in a 267 ml. Hull cell, a trapezoidal box of nonconducting material having the electrodes so arranged that a single plating experiment will provide a range of current densities from which optimum plating conditions can be conveniently determined. All tests were conducted or operated at room temperature (70° F) with mild agitation.

Examples 1, 3 and 7 are illustrative of baths which do not contain a pyridine or quinoline according to this invention. Examples 2, 4, 5, 6, 8, 9 and 10 demonstrate the use of baths containing the additives of this invention.

Examples 1 to 9 employed the following basic bath:

| INGREDIENT | AMOUNT |
|---|---|
| Sn as $Sn(BF_4)_2$ | 9.0 gm/liter |
| Pb as $Pb(BF_4)_2$ | 4.2 gm liter |
| $HBF_4$ free | 120 gm/liter |
| $H_3BO_3$ | 10 gm/liter |

EXAMPLE 1

2.4 gm/Hull cell (9.6 gm/1) (nonyl phenol/12 moles ethylene oxides condensate) were added to the basic bath. The bath provided a smooth matte deposit in the low current density range with about 25–30% of the high current density area being grey to black, burned deposits.

EXAMPLE 2

0.045 gm/Hull cell (0.18 gm/1) of α-picolinic acid were added to the bath of Example 1. The bath provided a smooth matte deposit in the high current density area and/or a semi-lustrous deposit in the low current density range.

EXAMPLE 3

0.025 gm/Hull cell (0.1 g/l) of the allylether of orthoxhydroxy-benzaldehyde were added to the bath of Example 1. The bath provided a brownish cast, semi-bright deposit over the entire test panel.

EXAMPLE 4

0.045 gm/Hull cell (0.18 g/l) of α-picolinic acid were added to the bath of Example 3. The bath provided a brilliant deposit over a current density range of 10–80 ASF.

EXAMPLE 5

0.04 ml/Hull cell (0.16 ml/l) of orthochlorobenzaldehyde were added to the bath of Example 4. The bath provided a brilliant deposit over a current density range of 5–80 ASF. The orthochlorobenzaldehyde also improved the low current density area.

EXAMPLE 6

0.12 ml/liter of picolinic acid and 0.4 ml/liter of orthodichlorobenzene were added to the bath of Example 1 and a bright Hull cell panel resulted from 10–40 ASF.

EXAMPLE 7

5 gm/liter of lauryl amine ethylene oxide condensate containing about 18 moles of ethylene oxide and 0.4 gm/liter of the allylether of orthohydroxybenzaldehyde were added to the basic bath. The bath provided a semi-bright, brownish nonuniform deposit with mottled type deposits. The bath was not commercially acceptable.

EXAMPLE 8

1.2 g/l of pyridine N-oxide were added to the bath of Example 7. A semi-uniform bright deposit resulted, however, it was not as good as Example 4 or 5.

EXAMPLE 9

1 ml/liter of a 37% solution of formaldehyde and 0.15 ml/liter of orthochlorobenzaldehyde were added to the bath of Example 2. The bath produced a semi-bright deposit in the current density range of 15–30 ASF and a bright deposit at 30–70 ASF.

EXAMPLE 10

The following ingredients were added to the basic bath:

| | |
|---|---|
| Nonyl phenol ethylene oxide condensate (14 mols ethylene oxide) | — 9 gm/l |
| Picolinic acid | — 0.15 gm/l |
| Allyl ether of salicylaldehyde | — 0.2 gm/l |
| Ortho-chloro benzaldehyde | — 0.15 gm/l |
| Thallium metal (as Thallium acetate) | — 0.18 gm/l |

The above bath was used to plate a tin-lead alloy in a Hull cell, as in the previous Example. The Hull cell panel was bright over a wide current density range including the low current density range down to about 0.5 ASF.

The basic formula may vary as is readily apparent to one skilled in the art. Varying the concentration of Sn, Pb and free $HBF_4$ will provide different tin-lead alloys. For example, by increasing the tin and lowering the lead content, alloys of 99% tin and 1% lead can be obtained.

It is also possible to utilize the compounds herein in other bath systems such as sulfamate and silicofluoride systems.

The pyridine compounds herein described have been found to be very selective for lead plating alone with the carboxy acids appearing to be the preferred compounds. It is, therefore, within the contemplation of this invention to plate lead by electrodeposition using at least one pyridine or picolinic acid compound according to this invention. Advantageous results are obtained by including an aldehyde vinyl ether as set forth herein as a component of the lead plating bath.

Baths containing an alkylene or alkyl ether of hydroxybenzaldehyde such as o-allylether of 2-hydroxybenzaldehyde have also been found to give excellent results for electroplating pure tin. Accordingly, it is also within the scope of this invention to electroplate tin from baths containing the aforesaid ingredients.

What is claimed is:

1. A bath for the electrodeposition of bright tin-lead alloys which comprises an aqueous acidic bath containing at least one soluble tin compound and one soluble lead compound to which there has been added:

a. a polyalkylene oxide condensation product; and b. at least one pyridine or quinoline compound having the structure

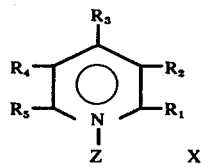

wherein the substituents $R_1$, $R_2$, $R_3$, $R_4$ and $R_5$ each is a hydrogen or halogen atom, a lower alkyl radical containing a hydroxyl group, an alkenyl radical, the radical $(C_nH_{2n})CO_2H$ in which n has a value from 0 to 6 or a carbamide radical or $R_4$ and $R_5$ combined form a divalent radical to provide a compound having the structure

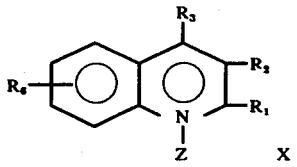

in which $R_6$ is nothing or a hydroxyl radical; Z is nothing, $O^-$ or a quaternary ammonium forming hydrocarbon radical provided that when Z is nothing, at least one of the substituents $R_1$, $R_2$, $R_3$, $R_4$ and $R_5$ is a halogen atom, a lower alkyl radical containing a hydroxyl group, an alkenyl radical, the radical $(C_nH_{2n}—CO_2H$ in which $n$ has a value from 0 to 6 or a carbamide radical or $R_6$ is a hydroxyl radical; and X is nothing or when Z is a quaternary ammonium forming hydrocarbon radical X is an anion, the condensation product, and pyridine or quinoline compounds being present in sufficient amount to increase the brightness of the tin-lead alloy deposit over a wide current density range above about 5 amps per square foot.

2. The bath of claim 1 which contains a soluble thallium compound in sufficient amount to increase the brightness of the deposit in the low current density ange below about 5 amps per square foot.

3. A bath according to claim 1 which also contains an aromatic aldehyde in sufficient concentration to increase the brightness of the tin-lead deposits electrodeposited therefrom.

4. The bath of claim 3 which contains a soluble thallium compound in sufficient amount to increase the brightness of the deposit in the low current density range above about 5 amps per square foot.

5. A bath according to claim 3 wherein the aromatic aldehyde is orthomethoxy benzaldehyde, 3-ethoxybenzaldehyde, o-tolualdehyde parachlorobenzaldehyde, cinnamaldehyde, orthochlorobenzaldehyde, furfural, 2-methoxy-4-hydroxybenzaldehyde, orthoallyl ether of 2-hydroxybenzaldehyde, o-propargyl ether of 2-hydroxybenzaldehyde, thiophene-2-aldehyde, orthofluorobenzaldehyde, dichlorobenzaldehyde, difluorobenzaldehyde or orthophthalaldehyde.

6. A bath according to claim 1 wherein the condensation product is an alkylene oxide/ethylene glycol condensation product, an ethylene oxide/nonylphenol condensation product or an ethylene oxide condensation product of the formula

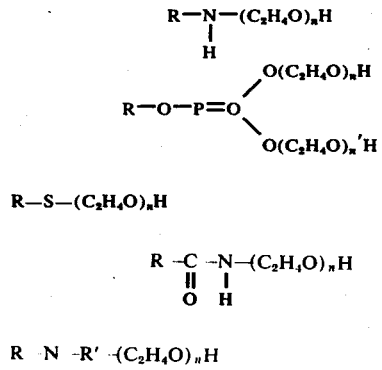

or $R—N—R'—(C_2H_4O)_nH$ wherein R is an alkyl or aryl radical containing 6 to 20 carbon atoms, R' is $(CH_2)_y$ wherein $y$ is an integer from 1 to 6 and $n$ and $n'$ are each an integer from 2 to 6.

7. A bath according to claim 6 wherein the condensation product is derived from nonylphenol condensed with about 12 moles of ethylene oxide.

8. A bath according to claim 1 wherein the compound of (b) is pyridine-2-carboxylic acid, 2-carboxy-n-methylpyridinium chloride, pyridine-2-6-dicarboxylic acid, nicotinamide, nicotinic acid, pyridine N-oxide, pyridine N-oxide-2-ethanol, pyridine-3-carboxylic acid quaternized with either dimethyl sulphate, methyl p-toluenesulphonate, benzylchloride, 3-chloromethylanisaldehyde or 3-chloromethylparahydroxybenzaldehyde, pyridine N-oxide-3-carboxylic acid, quinoline-2-carboxylic acid, 8-hydroxyquinoline, quinoline N-oxide, 2-vinylpyridine, 2-vinylpyridine N-oxide or 2-chloropyridine N-oxide.

9. A process for producing bright deposits of tin-lead alloys which comprises electrodepositing tin and lead from an aqueous acidic bath containing at least one soluble tin compound and one soluble lead compound to which there has been added:

a. polyalkylene oxide condensation product; and
b. at least one pyridine or quinoline compound having the structure

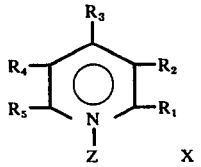

wherein the substituents $R_1$, $R_2$, $R_3$, $R_4$ and $R_5$ each is a hydrogen or halogen atom, a lower alkyl radical containing a hydroxyl group, an alkenyl radical, the radical ($C_nH_{2n}$—$CO_2H$ in which n has a value from 0 to 6 or a carbamide radical or $R_4$ and $R_5$ combined form a divalent radical to provide a compound having the structure

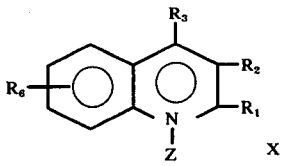

in which $R_6$ is nothing or a hydroxyl radical; Z is nothing, $O^-$ or a quaternary ammonium forming radical provided that when Z is nothing, at least one of the substituents $R_1$, $R_2$, $R_3$, $R_4$ and $R_5$ is a halogen atom, a lower alkyl radical containing a hydroxyl group, an alkenyl radical, the radical ($C_nH_{2n}$—$CO_2H$ in which n has a value from 0 to 6 or a carbamide radical or $R_6$ is a hydroxyl radical; and X is nothing or when Z is quaternary ammonium forming hydrocarbon radical X is an anion, the condensation product and the pyridine or quinoline compound being present in said bath in a sufficient amount to increase the brightness of the tin-lead alloy deposit over a wide current density range above about 5 amps per square foot.

10. The bath of claim 9 which contains a soluble thallium compound in an amount to increase the brightness of the deposit in the low current density range below about 5 amps per square foot.

11. A process according to claim 9 in which the bath contains a sufficient aromatic aldehyde in sufficient amount to increase the brightness of the tin-lead deposits.

12. The bath of claim 11 which contains a soluble thallium compound in sufficient amount to increase the brightness of the deposit in the low current density range below about 5 amps per square foot.

13. A process for producing bright deposits of tin-lead alloys according to claim 11 wherein the aromatic aldehyde is orthomethoxy benzaldehyde, 3-ethoxybenzaldehyde, o-tolualdehyde parachlorobenzaldehyde, cinnamaldehyde, orthochlorobenzaldehyde, furfural, orthoallyl ether of 2-hydroxybenzaldehyde, o-propbugyl ether of 2-hydroxybenzaldehyde, thiophene-2-aldehyde, orthofluorobenzaldehyde, dichlorobenzaldehyde, difluorobenzaldehyde or orthophthalaldehyde.

14. a process for producing bright deposits of tin-lead alloys according to claim 9 wherein the condensation product is an alkylene oxide/ethylene glycol condensation product, an ethylene oxide-nonylphenyl condensation product or an ethylene oxide condensation product of the formula

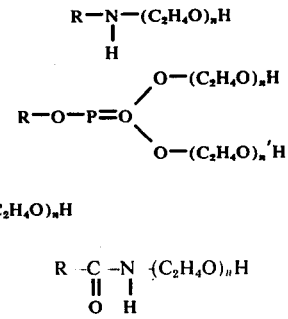

or $R—N(R')(C_2H_4O)_nH$ wherein R is an alkyl or aryl radical containing 6 to 20 carbon atoms, R′ is $(CH_2)_y$ wherein y is an integer from 1 to 6 and n and n′ are each an integer from 2 to 6.

15. A process for producing bright deposits of tin-lead alloys according to claim 14 wherein the condensation product is derived from nonylphenol condensed with about 10–14 moles of ethylene oxide.

16. A process for producing bright deposits of tin-lead alloys according to claim 9 wherein the compound of (b) is pyridine-2-carboxylic acid, 2-carboxy-n-methylpyridinium chloride, pyridine-2-6-dicarboxylic acid, nicotinamide, nicotinic acid, pyridine N-oxide, pyridine N-oxide-2-ethanol, pyridine-3-carboxylic acid quaternized with either dimethyl sulphate, methyl p-toluenesulphonate, benzylchloride, 3-chloromethylanisaldehyde or 3-chloromethylparahydroxybenzaldehyde, pyridine N-oxide-3-carboxylic acid, quinoline-2-carboxylic acid, 8-hydroxyquinoline, quinoline N-oxide, 2-vinylpyridine, 2-vinylpyridine N-oxide or 2-chloropyridine N-oxide.

* * * * *

UNITED STATES PATENT OFFICE

CERTIFICATE OF CORRECTION

Patent No. 4,000,047 Dated December 28, 1976

Inventor(s) Barnet D. Ostrow et al.

It is certified that error appears in the above-identified patent and that said Letters Patent are hereby corrected as shown below:

Column 5, third structure, reads "CO H" should read --$CO_2H$--

Column 7, line 30, reads $-CH_2)_y$ should read $\{CH_2\}_y$

Column 9, line 6, reads "of thallium" should read --of a thallium

Column 10, lines 6-7, reads "orthoxhydroxy" should read --orthohydroxy--

Col.2, line 26; Col.2, line 46; Col.11, line 62, Col.13, line 17; and Col.13, line 36 read $H_{2n}-$ should read $H_{2n}\}$ Column 12, line 6 reads "ange" should read --range--

Column 13, lines 37-38 reads "is quaternary" should read --is a quaternary--

Column 13, line 46 reads "in an amount" should read --in a sufficient amount--

Column 13, line 51-reads "contains a sufficient" should read --contains an aromatic--

UNITED STATES PATENT OFFICE

CERTIFICATE OF CORRECTION

Patent No. 4,000,047 Dated December 28, 1976

Inventor(s) Barnet D. Ostrow et al.

It is certified that error appears in the above-identified patent and that said Letters Patent are hereby corrected as shown below:

Column 14, lines 7-8 reads "furfural, orthoallyl" should read --furfural, 2-methoxy-4-hydroxybenzaldehyde, orthoallyl--

Column 14, lines 8-9 reads "o-propbugyl" should read --o-propargyl--

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*